US006585627B2

(12) United States Patent
Fernandez

(10) Patent No.: US 6,585,627 B2
(45) Date of Patent: Jul. 1, 2003

(54) WHEELED EXERCISER

(75) Inventor: Juan Fernandez, Ridgefield Park, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 0 days.

(21) Appl. No.: 09/766,832

(22) Filed: Jan. 23, 2001

(65) Prior Publication Data

US 2002/0025894 A1 Feb. 28, 2002

Related U.S. Application Data

(60) Provisional application No. 60/228,453, filed on Aug. 29, 2000.

(51) Int. Cl.[7] ..... A63B 71/00

(52) U.S. Cl. ..... 482/140; 482/132

(58) Field of Search ..... 482/95, 96, 116, 482/121, 126, 127, 132, 148, 907

(56) References Cited

U.S. PATENT DOCUMENTS

| | | | | |
|---|---|---|---|---|
| 6,017,296 A | | 1/2000 | Tang et al. | 482/132 |
| 6,146,318 A | | 11/2000 | Kuo | 482/132 |
| 6,264,587 B1 | * | 7/2001 | Lee | 482/132 |
| 6,348,027 B1 | * | 2/2002 | Lee | 482/127 |

FOREIGN PATENT DOCUMENTS

| | | |
|---|---|---|
| DE | 200 07 533 U1 | 8/2000 |
| TW | 88204282 | 11/1999 |

* cited by examiner

*Primary Examiner*—Nicholas D. Lucchesi
*Assistant Examiner*—Tam Nguyen
(74) *Attorney, Agent, or Firm*—Lerner, David, Littenberg, Krumholz & Mentlik, LLP

(57) ABSTRACT

A wheeled exerciser includes a pair of main traction wheels, a pair of auxiliary wheels, a housing with a receiving compartment, a main wheel axle, a mounting piece which can be attached securely onto the housing, a set of coil springs which can be attached with one of the ends of each coil spring onto a mounting piece and with the other end of each coil spring attached to each of the main traction wheels in such a manner that the springs are winded when the wheels turn, and a pair of handles which can be attached to the outer surface of the housing. In use, the user holds the handles with both hands, presses the wheels of the exerciser against the floor, and pushes the exerciser forward from a starting point. In the course of pushing the exerciser forward, the main traction wheels turn and wind up the springs. When the exerciser reaches the desired position, the user moves the exerciser backward with the help of the restoring force on the springs. FIG. 1 shows the exerciser wheel in use.

14 Claims, 4 Drawing Sheets

WHEELED EXERCISER

CROSS-REFERENCE TO RELATED APPLICATIONS

This application claims the benefit of U.S. Provisional Patent Application No. 60/228,435, filed Aug. 29, 2000, the entire disclosure of which is hereby incorporated by reference herein.

FIELD OF THE INVENTION

The present invention relates to exercise devices and, more particularly, to exercise wheels having handles that are used to exercise the abdominal region and other regions of a user's body.

BACKGROUND OF THE INVENTION

A number of wheeled exercisers are known in the art. One exerciser is shown in U.S. Pat. No. 6,017,296 which pertains to an exerciser manufactured by the present assignee called the ABSLIDE™ exerciser. The ABSLIDE™ can be used to exercise the abdominal and other regions of a user's body. A number of other wheeled exercisers are also known.

There are a variety of ways that some existing exercisers can be improved upon. In some existing exercisers, for example, the exercisers either require the user to hold the handles firmly against the restored turning force of the spring(s) or have the storing force of the spring(s) transmitted through a set of gears which may tend to reduce the effectiveness of the restoring spring force. Many existing exercisers have one or more non-optimal characteristic, such as being cumbersome, costly, unstable, complex and/or otherwise non-optimal.

SUMMARY OF THE INVENTION

The preferred embodiments of the present invention provide a wheeled exercise device that substantially improves upon existing devices.

The preferred embodiments of the present invention provide a wheeled exerciser which can be operated steadily and stably.

The preferred embodiments of the present invention provide a wheeled exerciser with adequate resistance in moving the exerciser forward such that the user can control the movement of the exerciser very easily and safely.

The preferred embodiments of the present invention provide a wheeled exerciser with a restoring force after traveling forward to a desired position, so as to lessen the manual effort required to move the wheeled exerciser backward to its original starting position.

The preferred embodiments of the invention can, for example, improve:

1. the stability of a wheeled exerciser by providing increase span of support by the exerciser's wheels;
2. the control of the exerciser by making the restoring force on spring loaded exerciser more directly and effectively acting on the exerciser without the need of holding the handles firmly; and/or
3. the steadiness of the exerciser by implementing adequate frictional force against the turning of the wheels of the exerciser.

According to preferred embodiments of the present invention, the wheeled exerciser is arranged with two main traction wheels and two auxiliary wheels pivoted on a housing with a receiving compartment. Adequate spacing is provided between the wheels to ensure stability of the exerciser. Preferably, one or two springs are used to provide restoring force against forward movement of the exerciser. This restoring force can help the user to spend less effort in moving the exerciser backward on its returning travel. Preferably, one end of each spring is fixed to the housing of the exerciser and another end of the spring is attached to a main traction wheel of the exerciser so that the spring storing force will act directly on the main traction wheel and will not act on the handles of the exerciser. Preferably, plain bearings are used to provide some friction on the main traction wheels when the user presses them against the floor or the ground. The frictional force can help the user to master the movement of the exerciser steadily and without slippage.

The above and other aspects, features and advantages of various embodiments of the invention will be further appreciated based on the following detailed description of the invention taken in conjunction with the accompanying drawings of the preferred embodiments.

BRIEF DESCRIPTION OF THE DRAWINGS

The accompanying drawings show preferred, non-limiting, embodiments of the invention.

DETAILED DESCRIPTION OF THE PREFERRED EMBODIMENTS OF THE INVENTION

Figure 1:
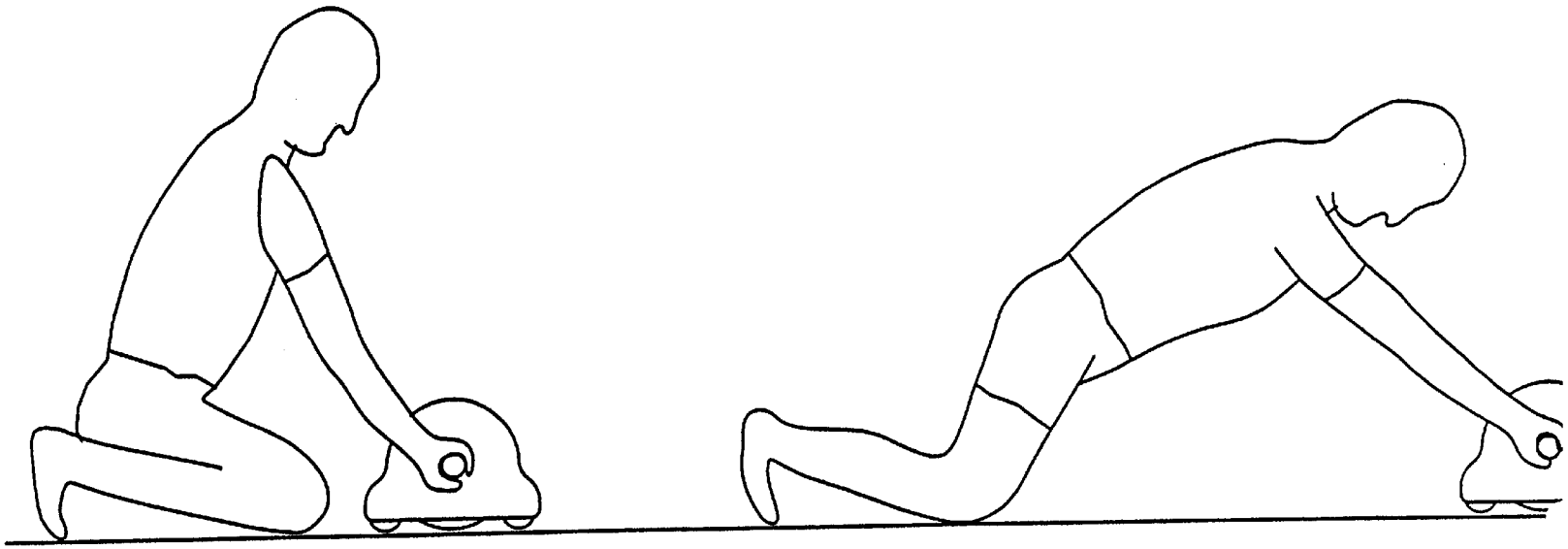
FIG. 1 shows one way a user can operate a wheeled exerciser according to the illustrated embodiment.
Figure 2:
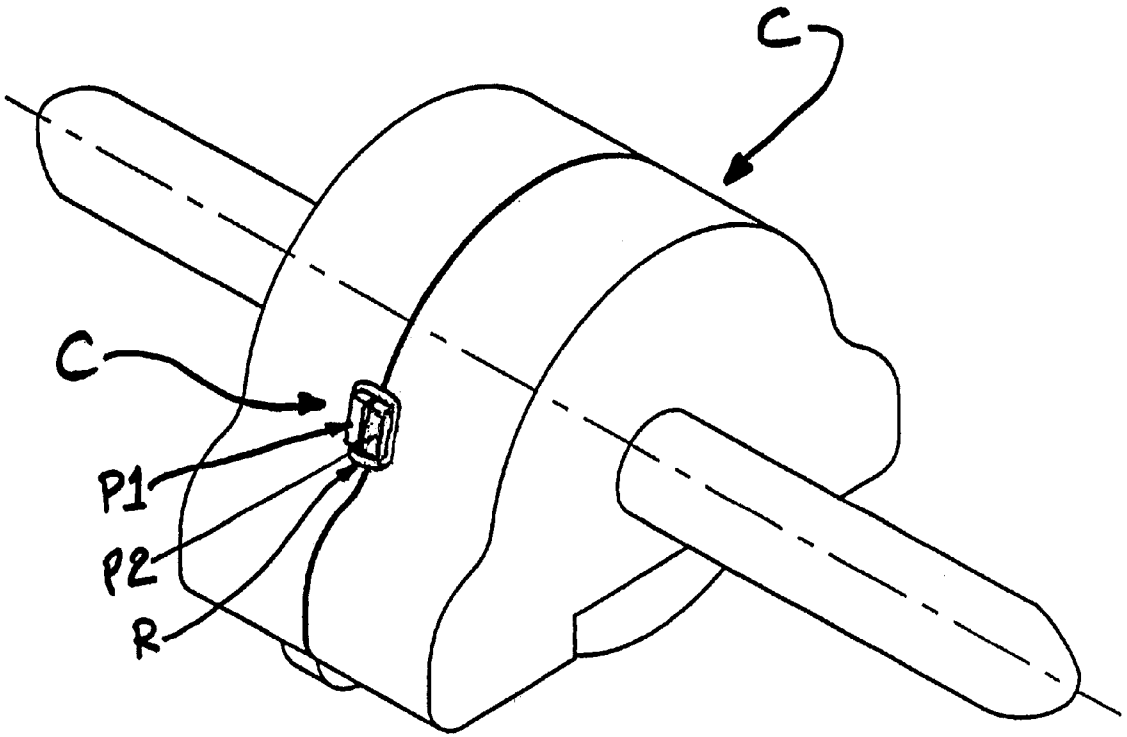
FIG. 2 shows a perspective view of the wheeled exerciser according to the illustrated embodiment of the present invention.
Figure 3:
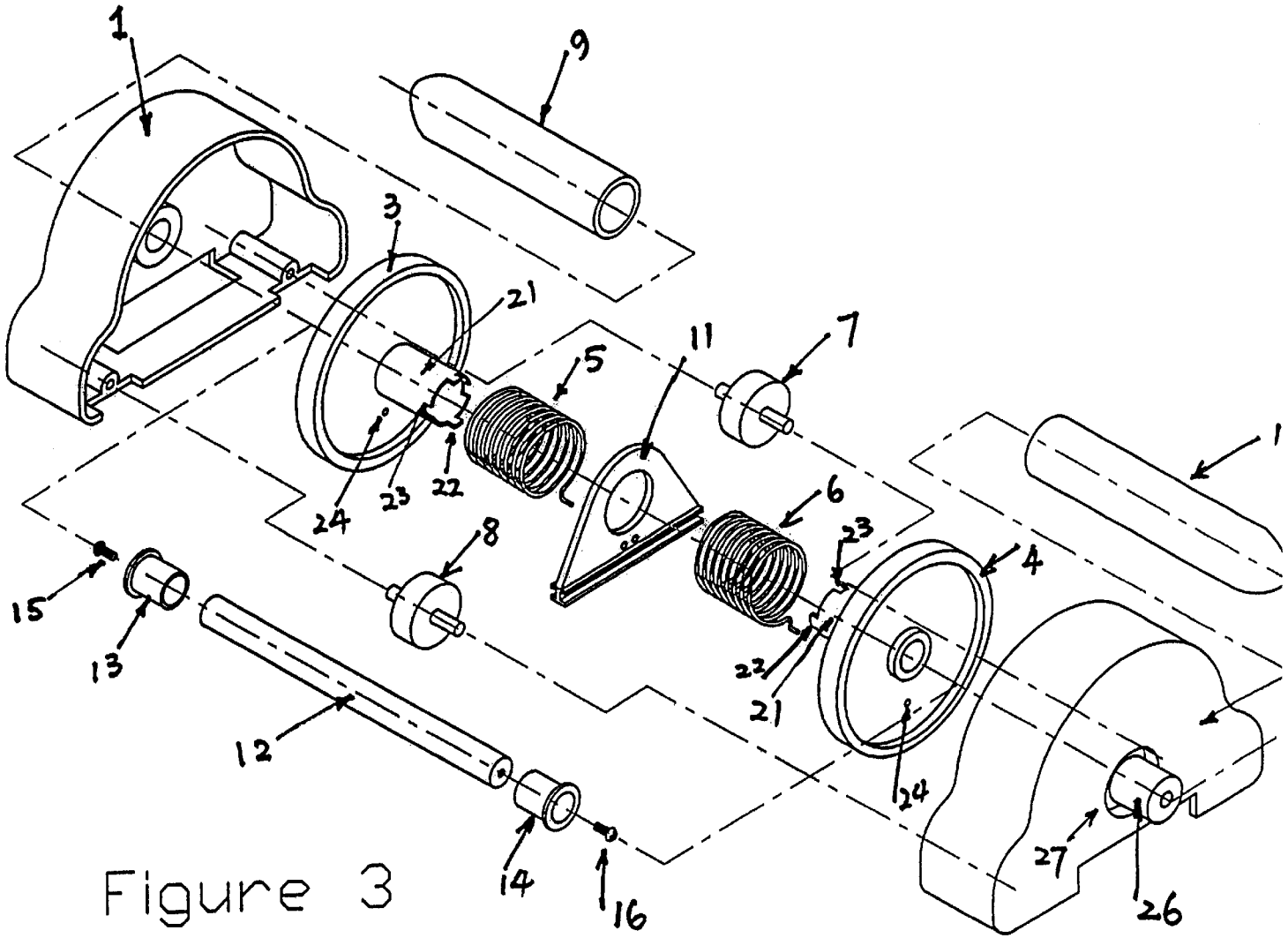
FIG. 3 shows an exploded view of the wheeled exerciser of the illustrated embodiment of the present invention.
Figure 4:
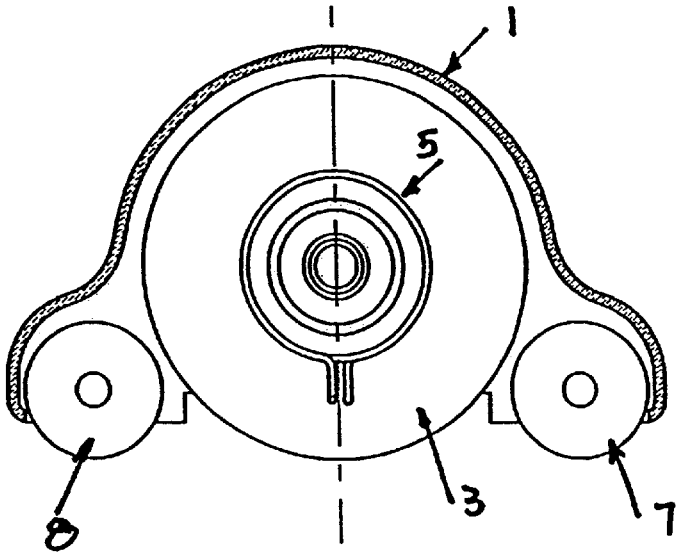
FIG. 4 shows a sectional view of a portion of the wheeled exerciser of the illustrated embodiment as viewed in a direction parallel to the axes of the main traction wheels.

As shown in FIGS. 2 and 3, a wheeled exerciser in the preferred embodiments of the present invention includes a left-hand half-housing 1, a right-hand half-housing 2, a left-hand main traction wheel 3, a right-hand main traction wheel 4, a left-hand coil spring 5, a right-hand coil spring 6, a front auxiliary wheel 7, a rear auxiliary wheel 8, a left-hand handle 9, a right-hand handle 10, a spring mounting plate 11, a wheel axle 12, a left-hand wheel plain bearing 13, a right-hand wheel plain bearing 14, a left-hand mounting screw 15, and a right-hand mounting screw 16.

Figure 5:
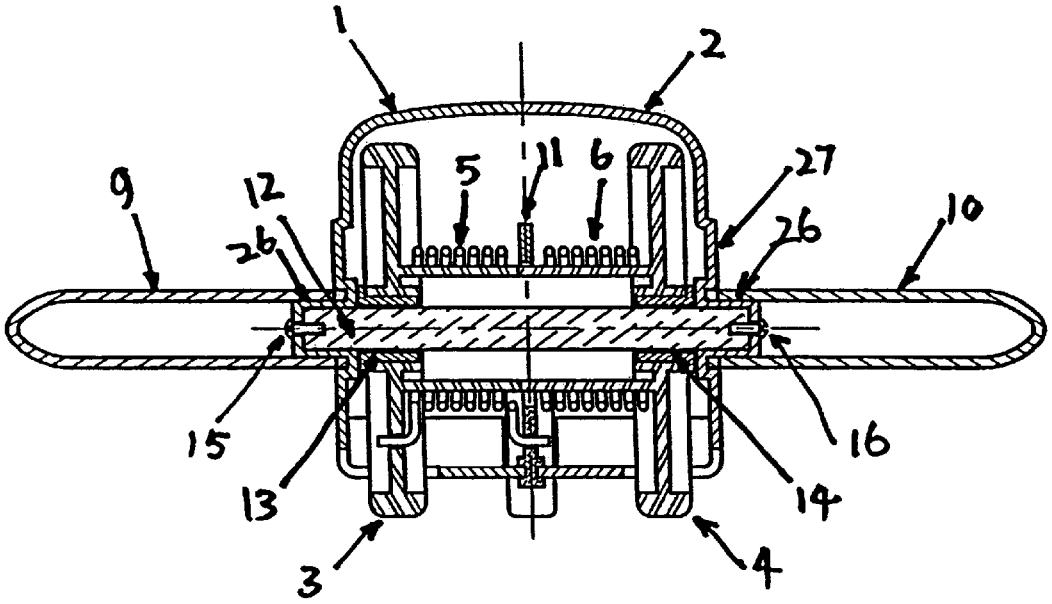
FIG. 5 shows a sectional view of a portion of the wheeled exerciser of the illustrated embodiment as viewed in a direction perpendicular to the axes of the main traction wheels.

The left-hand half-housing 1 and right-hand half-housing 2, when assembled together, form a compartment containing all the other component parts except the handles 9 and 10. A steel rod 12 is used as an axle for the main traction wheels 3 and 4. Both ends of rod 12 are drilled and tapped with female treads fit the two mounting screws 15 and 16. This rod can be made in hollow steel tube with both of its ends plugged to provide the female threads for the screws. As shown in FIG. 5, when the rod is assembled into the left-hand half-housing and right-hand half-housing, both ends of this rod go into recess holes 51 and 52 in the half-housing. When the screws 15 and 16 are fastened to the ends of the rod 12, they hold the half-housings 1 and 2 together. Other screws may also be used for securing the half-housings 1 and 2 together.

Each of the main traction wheels has tubular bodies 21 extended from the large face of the wheel. These tubular bodies help to keep the coil springs 5 and 6 in the correct mounting position.

The tubular bodies on the traction wheels are made a sufficient length so that the span between the two traction wheels is large enough to ensure stability of the exerciser. The two main traction wheels 3 and 4 are coupled together by mating the projected wall 22 and recessed slot 23 on the tubular bodies of the wheels, such that the two traction wheels 3 and 4 are synchronized in turning. The plain bearings 13 and 14 are pressed fitted into the central holes on the main traction wheels 3 and 4, and serves as the sliding element on the stationery axle 12 when the traction wheels turn. The friction that acts between these bearings and axles provide adequate resistance to the turning of the wheel and hence prevent accidental slippage when the wheeled exercise is in use.

Two coil springs, the left-hand coil spring 5 and right-hand coil spring 6, are assembled over the tubular bodies of the traction wheels. One end of each coil spring goes into a small hole 24 on a respective traction wheel, and another end of each coil spring goes into another hole on the spring mounting plate 11. When assembled, the spring mounting plate 11 is held together securely by the left-hand half-housing 1 and right-hand half-housing 2. Consequently, when the traction wheels 3 and 4 turn as the user moves the exerciser forward on the floor, the coil springs 5 and 6 are winded. The restoring force on the springs thus directly acting on the wheels and hence it provides an effective means of transmitting the restoring force onto the exerciser.

Preferably, two auxiliary wheels 7 and 8 are pivoted on the front and rear parts of the housing, respectively. These two wheels can, for example, maintain the exerciser in a horizontal position at all times, and add to the stability of the exerciser. Preferably, these auxiliary wheels are substantially smaller in diameter than the traction wheels 3 and 4. Preferably, these auxiliary wheels are freely rotatable without restoring forces via springs or the like.

Preferably, a tubular pole 26 extends through the half-housings and projects outward via lateral holes in the outer surfaces 27 of each half-housing—i.e., the left-hand half-housing and the right-hand half-housing. Two handles, a left-hand handle 9 and a right-hand handle 10, are each designed with a hallow end to fit over the pole 26 on the housing. In this way, the user can hold both handles with his hands and operate the exerciser.

As shown in FIG. 2, in some embodiments, the half-housing 1 and the half-housing 2 can also be further retained together with a mechanical coupling. Preferably, the half-housings 1 and 2 are further retained together with one or more metal coupling, such as a metal ring, buckle or coupler. In the illustrated embodiment, two metal couplings C can be provided on front and rear sides of the device. As shown, each half-housing 1 and 2 includes adjacent projections P1 and P2 that are retained by a coupling ring R in the illustrated example.

While the present invention has been described with respect to preferred embodiments of the invention, the present invention is not limited thereto, but includes any and all modifications, equivalents and variations as would be apparent to those in the art based on this disclosure.

What is claimed is:

1. A wheeled exerciser, comprising:

a) a housing;

b) an axle rod extending through said housing;

c) two traction wheels rotatably supported on said axle rod, said traction wheels extending through a bottom of said housing;

d) a first spring fixedly connected to one of said traction wheels and to said housing;

e) a front auxiliary wheel rotatably mounted to said housing at a position in front of said axle rod; and f) a rear auxiliary wheel rotatably mounted to said housing at a position behind said axle rod.

2. The exerciser of claim 1, wherein said auxiliary wheels are freely rotatable within said housing.

3. The exerciser of claim 2, wherein said auxiliary wheels are located substantially along a common plane passing substantially centrally to said two traction wheels and substantially perpendicularly to said axle rod.

4. The exerciser of claim 2, wherein said auxiliary wheels are substantially smaller in diameter than said traction wheels.

5. The exerciser of claim 4, wherein a diameter of each said auxiliary wheel is less than a radius of each said traction wheels.

6. A wheeled exerciser comprising:

a housing;

an axle rod extending through said housing;

two traction wheels rotatably supported on said axle rod, said traction wheels extending through a bottom of said housing;

a first spring fixedly connected to one of said traction wheels and to said housing wherein said first spring is a torsion spring having a first end connected to said one of said traction wheels, a helical portion that winds around said axle, and a second end connected to said housing via a plate that is fixedly connected to said housing;

a front auxiliary wheel rotatably mounted to said housing at a position in front of said axle rod; and a rear auxiliary wheel rotatably mounted to said housing at a position behind said axle rod.

7. The exerciser of claim 1, wherein said housing includes: generally flat left and right sides having a generally central opening for a handle; a generally cylindrical top wall extending over said traction wheels and having a slightly larger diameter than said traction wheels; and a front extension extending over the front auxiliary wheel and a rear extension extending over the rear auxiliary wheel.

8. A wheeled exerciser, comprising:

a housing means for packaging at least an upper visible portion of the exerciser;

an axle rod extending through said housing means;

two traction wheels rotatably supported on said axle rod, said traction wheels extending through a bottom of said housing;

spring means attached between said traction wheels and said housing, wherein said spring means includes at least one torsion spring having a first end connected to said one of said traction wheels, a helical portion that winds around said axle, and a second end connected to said housing via a plate that is fixedly connected to said housing a front auxiliary wheel rotatably mounted to said housing at a position in front of said axle rod, and means for allowing said front auxiliary wheel to rotate freely; and a rear auxiliary wheel rotatably mounted to said housing at a position behind said axle rod, and means for allowing said rear auxiliary wheel to rotate freely.

9. A method of exercising the abdominal region, comprising:

i) providing an exerciser having:

a) a housing;

b) an axle rod extending through said housing;

c) two traction wheels rotatably supported on said axle rod, said traction wheels extending through a bottom of said housing;

d) a first spring fixedly connected to one of said traction wheels and to said housing;

e) a front auxiliary wheel rotatably mounted to said housing at a position in front of said axle rod; and f) a rear auxiliary wheel rotatably mounted to said housing at a position behind said axle rod;

ii) having a user grasp handles extending from opposite sides of said housing while kneeling on a ground surface and then lean forward such that said traction wheels roll along the ground surface and return resistance force is applied via said first spring while said front and rear auxiliary wheels roll freely along the ground surface.

10. The method of claim 9, including providing said auxiliary wheels substantially along a common plane passing substantially centrally to said two traction wheels and substantially perpendicularly to said axle rod.

11. The method of claim 10, further including providing said auxiliary wheels substantially smaller in diameter than said traction wheels.

12. The method of claim 11, further including providing a diameter of each said auxiliary wheel as less than a radius of each said traction wheels.

13. The method of claim 9, wherein said first spring is a torsion spring having a first end connected to said one of said traction wheels, a helical portion that winds around said axle, and a second end connected to said housing via a plate that is fixedly connected to said housing.

14. A method of exercising the abdominal region, comprising:

a housing, the housing comprising:

an axle rod extending through said housing and acting as a handle;

two traction wheels rotatable supported on said axle rod, said traction wheels extending through a bottom of said housing;

a first spring fixedly connected to one of said traction wheels and to said housing;

a front auxiliary wheel rotatably mounted to said housing at a position in front of said axle rod;

a rear auxiliary wheel rotatably mounted to said housing at a position behind said axle rod;

wherein said housing further comprises:

generally flat left and right sides having a generally central opening for a handle;

a generally cylindrical top wall extending over said traction wheels and having a slightly larger diameter than said traction wheels; and a front extension extending over the front auxiliary wheel and a rear extension extending over the rear auxiliary wheel; and grasping the handle while kneeling on a ground surface leaning forward such that said traction wheels roll along the ground surface, while return resistance force is applied via said first spring while said front and rear auxiliary wheels roll freely along the ground surface.

* * * * *

UNITED STATES PATENT AND TRADEMARK OFFICE

CERTIFICATE OF CORRECTION

PATENT NO. : 6,585,627 B2
DATED : July 1, 2003
INVENTOR(S) : Juan Fernandez

It is certified that error appears in the above-identified patent and that said Letters Patent is hereby corrected as shown below:

Column 3,
Lines 16-18, "provide adequate resistance to the turning of the wheel and hence prevent accidental slippage when the wheeled exercise is in use" should read -- provides adequate resistance to the turning of the wheel and hence prevents accidental slippage when the wheeled exerciser is in use --.
Line 30, "acting on" should read -- acts on --.
Line 45, "hallow" should read -- hollow --.

Column 4,
Line 21, "wheels" should read -- wheel --.
Line 59, "housing" should read -- housing; --.

Column 5,
Line 31, "wheels" should read -- wheel --.

Column 6,
Line 27, "ground surface" should read -- ground surface, --.

Signed and Sealed this

Thirtieth Day of September, 2003

JAMES E. ROGAN
*Director of the United States Patent and Trademark Office*